United States Patent [19]

Gilliland et al.

[11] Patent Number: 4,534,641

[45] Date of Patent: Aug. 13, 1985

[54] CHARGE ERASE DEVICE FOR COPYING OR REPRODUCTION MACHINES AND PRINTERS

[75] Inventors: W. Keith Gilliland, Webster; Lawrence M. Hart, Ontario; Charles Nesta, Rochester, all of N.Y.

[73] Assignee: Xerox Corporation, Stamford, Conn.

[21] Appl. No.: 547,200

[22] Filed: Oct. 31, 1983

[51] Int. Cl.[3] ..... G03G 15/00

[52] U.S. Cl. ..... 355/3 R; 355/15; 355/3 CH; 355/14 CH; 355/1

[58] Field of Search ..... 355/3 R, 14 R, 15, 3 DD, 355/14 P, 14 E, 3 CH, 14 CH, 1; 118/652; 350/413, 96.27, 96.31

[56] References Cited

U.S. PATENT DOCUMENTS

| | | | |
|---|---|---|---|
| 3,455,637 | 7/1969 | Howard | 356/204 |
| 3,535,018 | 10/1970 | Vasilatos | 350/96 |
| 3,617,109 | 11/1971 | Tien | 350/96 |
| 3,649,262 | 3/1972 | Cade et al. | 355/15 X |
| 3,778,148 | 12/1973 | Fujitsuka et al. | 355/15 |
| 3,838,921 | 10/1974 | Sargis | 355/15 |
| 3,845,239 | 10/1974 | Granzow et al. | 178/6 |
| 4,244,647 | 1/1981 | Fujiwara et al. | 355/14 R |
| 4,336,993 | 6/1982 | Banton | 355/3 R |
| 4,352,550 | 10/1982 | Uchida | 355/3 R |
| 4,389,655 | 6/1983 | Baues | 355/1 X |
| 4,427,284 | 1/1984 | Dannatt | 355/1 |
| 4,462,662 | 7/1984 | Lama | 355/1 X |

*Primary Examiner*—A. C. Prescott

*Attorney, Agent, or Firm*—Frederick E. McMullen

[57] ABSTRACT

An erase device for removing residual charges from the photoreceptor of a xerographic type reproduction machine or printer preparatory to recharging, comprising, an elongated rectangular light conducting bar or fiber adapted for disposition with one side thereof in preset spaced relation to the photoreceptor surface; a light impervious cover about the remaining sides of the fiber to prevent escape of light from the interior thereof; an illumination cavity at one end of the fiber; a lamp in the cavity in operative relationship within the fiber end, the lamp and cavity cooperating so that light is discharged by the lamp into the fiber for transmittal axially within the fiber toward the fiber opposite end, portions of the light in the interior of the fiber escaping through the fiber one side to impinge upon the photoreceptor surface and discharge the photoreceptor; the fiber one side being roughened so that the light exit area progressively increases in proportion to the distance from the lamp, the roughened portion enabling the discharge of light through the fiber one side and providing a proportionally increasing light emitting surface in accommodation of the fall off in light intensity as the distance from the lamp increases.

In a second embodiment, the fiber is semi-circular in cross section, the rounded portion of the fiber being covered with a cladding material to prevent the escape of light therefrom while permitting the discharge of light from the uncovered flat portion of the fiber, the fiber being positionable with the flat portion thereof in preset spaced relation to the photoreceptor surface, the surface area of the fiber flat portion being roughened to enable the discharge of light from the fiber and progressively increasing in proportion to the distance from the lamp to accommodate fall off in the intensity of the light discharged from the fiber as the distance from the lamp increases.

7 Claims, 4 Drawing Figures

MEMORY
up
10
12
14
15
16
17
18
19
20
21
22
23
24
25
26
28
30
31
32
33
34
35
37
40
41
43
44
45
47
49
50
51
52
53
54
56
57
62
63
64

CHARGE ERASE DEVICE FOR COPYING OR REPRODUCTION MACHINES AND PRINTERS

The invention relates to devices for removing residual charges on the photoreceptor in a xerographic system preparatory to recharging, and more particularly, to an improved low cost charge erasing device particularly useful for discharging photoreceptors which require light with infra red content.

In xerographic type reproduction or printing machines, the machine photoreceptor is first charged in preparation for imaging. Thereafter, the charged photoreceptor is exposed to create, through selective discharge of the previously charged photoreceptor surface, a latent electrostatic image which is then developed, transferred to a suitable copy substrate material, and fused or fixed to provide a permanent copy. Following transfer of the developed image, the photoreceptor surface is cleaned as by a cleaning brush or blade which removes any leftover developing material still on the photoreceptor surface. However, residual charges may still remain on the photoreceptor and these must be removed prior to recharging of the photoreceptor if the uniform controlled charge necessary for the xerographic process is to be obtained.

Heretofore, erasing devices for removing residual charges from the photoreceptor were typically a lamp. More recent practice has been to use an electroluminescent panel for this purpose. Whatever the type of erasing device, the device was mounted opposite to the photoreceptor surface at some convenient point upstream of the charging station with a length sufficient to span the width of the photoreceptor. However, in the case of photoreceptors requiring light with red/infrared content, conventional erasing devices such as electroluminescent panels have been found to be not able to effectively erase residual charges in the photoreceptor bulk without undesirable side effects, principally, electric ghosting and deterioration and loss of the photoreceptor's ability to accept charge over a period of time. In this context, it is obviously also desirable to provide an effective erasing device of low cost and small size, the latter being especially critical inasmuch as it enhances the ability of the machine designer to locate the erasing device in a desired operating position in the machine.

In an attempt to cure or at least alleviate the above problems, the invention provides an erase device for use in dissipating charges on the surface of the photoreceptor in a xerographic reproduction machine which comprises: an elongated light transmitting fiber positionable opposite the photoreceptor surface and at substantially right angles to the path of movement of the photoreceptor, the axial length of the fiber being at least equal to the width of the photoreceptor surface; a light source at at least one end of the fiber, light from the light source entering the fiber and being transmitted axially along the interior thereof toward the fiber opposite end; means for limiting the discharge of light from the fiber to the surface of the fiber facing the photoreceptor so that light discharged by the fiber impinges on the photoreceptor surface to discharge charges thereon; and means for progressively increasing the light discharge area of the fiber surface in proportion to the distance along the fiber from the light source to thereby offset the loss of light intensity as the light is transmitted axially along the fiber.

Figure 1:
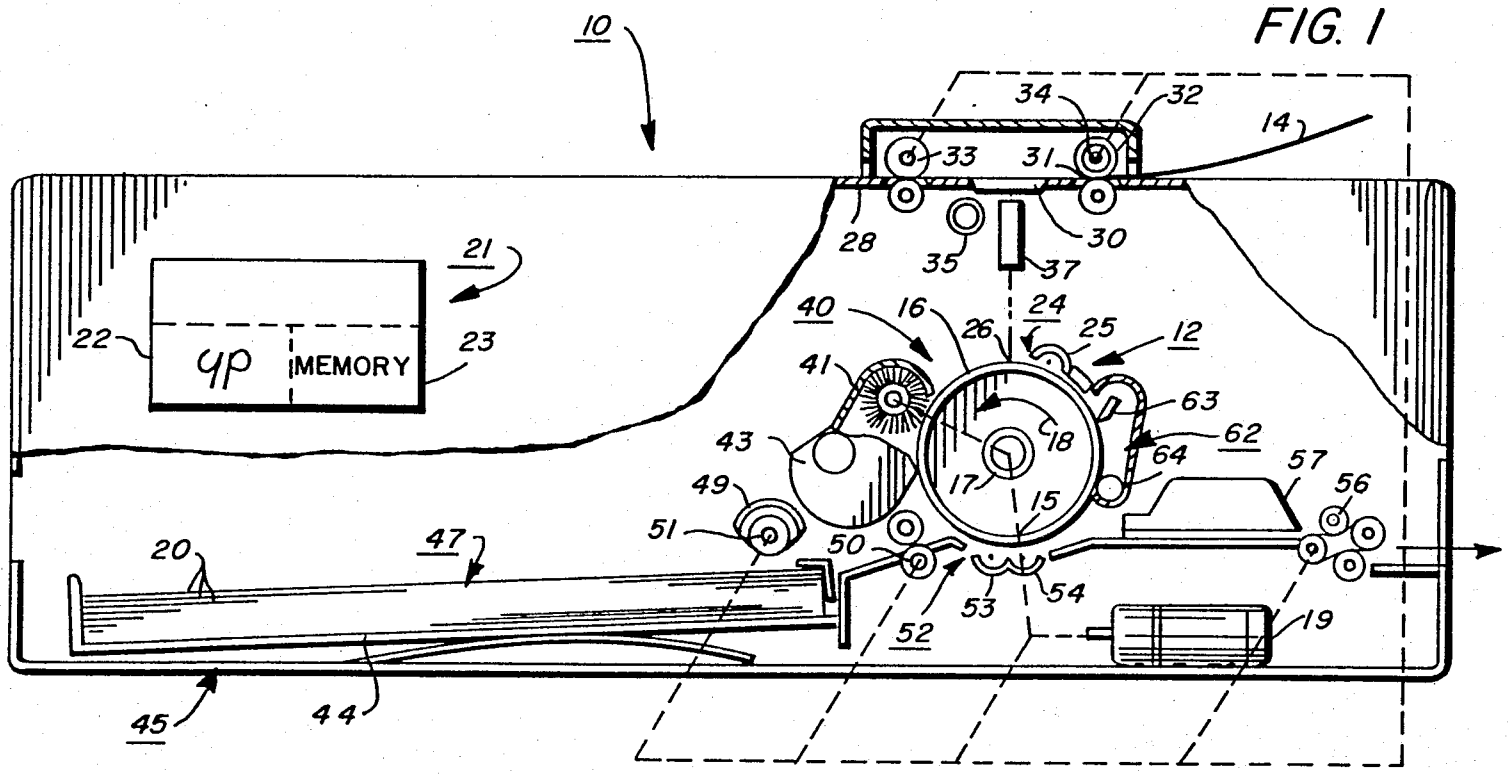
FIG. 1 is a side view depicting a xerographic reproduction machine or printer of the type adapted to incorporate the erase device of the present invention.

Referring to FIG. 1 of the drawings, there is shown by way of example an automatic xerograhic reproduction or printing machine, designated generally by the numeral 10 incorporating the erase device 12 of the present invention.

The reproduction machine 10 depicted in FIG. 1 illustrates the various components utilized in machines of this type for producing copies of a document original 14. Although the erase device 12 of the present invention is particularly well adapted for use in reproduction machine 10, it should become evident from the following description that it is equally well suited for use in a wide variety of other reproduction and printing machine types and systems and is not necessarily limited in application to the particular embodiment or embodiments shown herein.

Reproduction machine 10 has an image recording photoreceptor 15 in the form of a drum, the outer periphery of which has a suitable photoconductive material 16. Photoreceptor 15 is suitably journaled for rotation within the machine frame (not shown) as by means of shaft 17. A main drive motor 19 is drivingly coupled to photoreceptor 15, motor 19 rotating photoreceptor 15 in the direction indicated by arrow 18 to bring the photoconductive surface 16 of photoreceptor 15 past a series of xerographic processing stations. A suitable controller 21 with microprocessor 22 and memory 23 is provided for operating in predetermined timed relationship the various components that comprise machine 10 to reproduce the document original 14 upon a sheet of final support material such as copy sheet 20. As will be understood by those familiar with the art, memory 23 may comprise suitable read only memory (ROM), random access memory (RAM), and/or non-volatile memory (NVM), memory 23 serving to store the various operating parameters for reproduction machine 10 and the copy run information programmed by the machine user or operator.

Initially, the photoconductive surface 16 of photoreceptor 15 is uniformly charged by a suitable charging device such as scorotron 25 at charging station 24. The uniformly charged photoconductive surface 16 is exposed at exposure station 26 to create a latent electrostatic image of the document original 14 on photoreceptor 15. For this purpose, a suitable supporting surface or platen 28 for document original 14 is provided having a scan aperture or slit 30 therethrough. A suitable document transport, depicted herein as inlet and outlet constant velocity roll pairs 32, 33, is provided for transporting the document original past scan slit 30. Roll pairs 32, 33 are drivingly coupled to main drive motor 19, roll pair 32 being coupled through an electromagnetically operated clutch 34. A suitable document sensor 31 is provided at the inlet to platen 28 for sensing the insertion of a document original 14 to be copied and initiating operation of the reproduction machine 10.

A lamp 35, which is disposed below platen 38, serves to illuminate scan slit 30 and the line-like portion of the document original 14 thereover. A suitable fiber optic type lens array 37 which may for example comprise an array of gradient index fiber elements, is provided to optically transmit the image rays reflected from the line-like portion of the document original being scanned to the photoconductive surface 16 of photoreceptor 15 at exposure station 26.

Following exposure, the latent image on the photoconductive surface 16 of photoreceptor 15 is developed at a development station 40. There, a suitable developer such as magnetic brush roll 41, which is drivingly coupled to main drive motor 19, brings a suitable developer mix in developer housing 43 into developing relation with the latent image to develop the image and render the same visible.

Copy sheets 20 are supported in stack-like fashion on base 44 of copy sheet supply tray 45. Suitable biasing means are provided to raise base 44 of tray 45 and bring the topmost copy sheet 20 in the stack of sheets 47 into operative relationship with segmented feed rolls 49. Feed rolls 49 are driven by main drive motor 19 through an electromagnetically operated clutch 51. Rolls 49 serve upon actuation of clutch 51 to feed the topmost copy sheet forward into the nip of a registration roll pair 50 which register the copy sheet with the image on the photoconductive surface 16 of photoreceptor 15. Registration roll pair 50 advance the copy sheet to transfer station 52. There, suitable transfer/detack means such as transfer/detack corotrons 53, 54 bring the copy sheet into transfer relation with the developed image on photoconductive surface 16 and separate the copy sheet therefrom for fixing and discharge as a finished copy.

Following transfer station 52, the image bearing copy sheet is transported to fuser 57, which may for example comprise a radiant type fuser, where the image is permanently fixed to the copy sheet. Following fusing, the finished copy is transported by roll pair 56 to a suitable receptacle such as an output tray (not shown). Registration roll pair 50 and transport roll pair 56 are driven by main drive motor 19 through suitable driving means such as belts and pulleys.

Following transfer, residual developer remaining on the photoconductive surface 16 of photoreceptor 15 is removed at cleaning station 62 by means of cleaning blade 63. Developer removed by blade 63 is deposited into a suitable collector 64 for removal.

While a drum type photoreceptor is shown and described herein, it will be understood that other photoreceptor types may be employed such as belt, web, etc.

To permit effective and controlled charging of the photoconductive surface 16 by scorotron 25 to a predetermined level necessitates that any residual charges on the photoconductive surface 16 or trapped in the photoreceptor bulk be removed prior to charging. The erase device 12 of the present invention is provided for this purpose.

Figure 2:
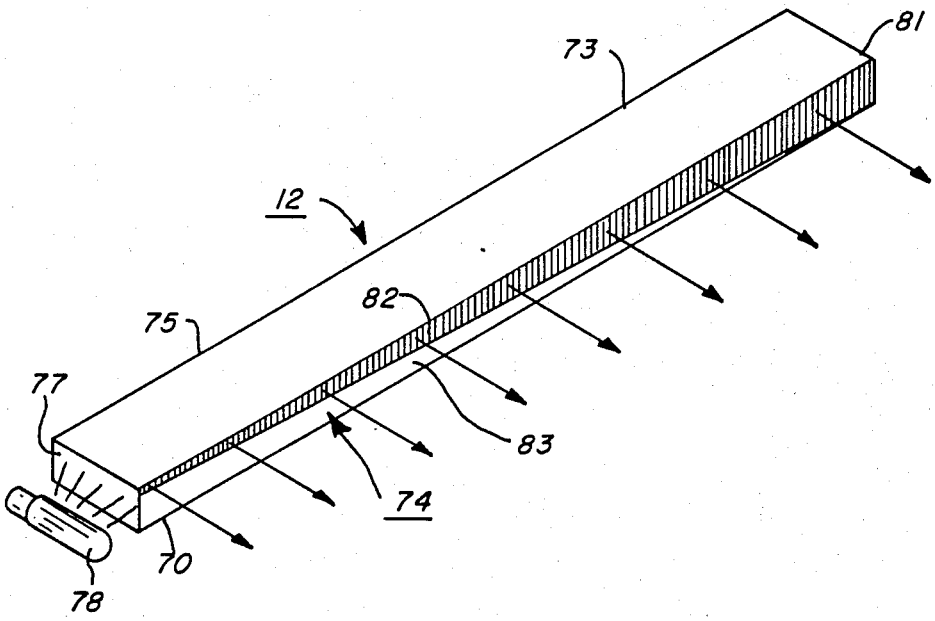
FIG. 2 is an isometric view of the erase device of the present invention.
Figure 3:
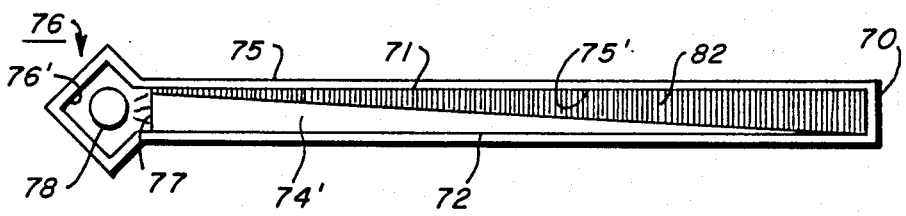
FIG. 3 is a side view in cross section of the erase device shown in FIG. 2.

Referring now to FIGS. 2 and 3 of the drawings, erase device 12 comprises an elongated light transmitting rod or bar-like fiber 70, which in the embodiment shown, is generally rectangular in cross section. This axial length of fiber 70 is at least equal to and preferably slightly greater than the operating width of photoreceptor 15. A light impervious cover 75, the internal surface 75' of which preferably comprises a reflective surface, is provided on the top, bottom, and rear walls 71, 72, 73 respectively of fiber 70. Cover 75 serves to prevent the escape of light from the interior of fiber 70 through the walls 71, 72, 73 with the reflecting surface provided by the cover interior 75' enhancing the light capturing and transmitting efficiency of fiber 70 by reflecting light striking the walls 71, 72, 73 back into the fiber interior.

An illumination cavity 76 is provided at one end 77 of fiber 70 within which a suitable lamp 78, such as a tungsten filament type lamp, is disposed. The interior surfaces 76' of illumination cavity 76 are preferably mirrored to enhance the light output of lamp 78 into fiber 70. Lamp 78 is disposed in cavity 76 in optical alignment and proximity to end 77 of fiber 70 such that on illumination of lamp 78, light therefrom enters the fiber 70 and is transmitted axially therealong. Preferably, where cover 75 is composed of a rigid element such as metal, plastic, etc, the cover 75 and illumination cavity 76 are formed as a single unit with fiber 70 and lamp 78 being assembled therewithin to provide erase device 12. The opposite end 81 of fiber 70 is preferably covered by a suitable light reflecting material having an internal mirror surface to enhance the light capturing abilities of fiber 70.

As will be understood, light entering fiber 70 is transmitted axially along the fiber interior, the rays of light impinging against walls 71, 72, 73 being prevented from escaping and being reflected back into the fiber interior by the inner reflective surface 75' of cover 75. As will appear, a controlled part 74' of the light rays striking the uncovered front wall 74 of fiber 70 are similiarly reflected back into the interior of the fiber 70 with the remainder passing through the wall section 82 to expose the photoconductive surface 16 of photoreceptor 15 and discharge any residual charges thereon.

It will be understood that the light transmitting efficiency of fiber 70 increases as the distance from the light source 78 increases. To render the light emissions from front wall 74 of fiber 70 substantially uniform along the length of fiber 70, a progressively increasing area of the surface of wall 74 starting at end 77 is suitably roughened at 82 as by sanding with a medium grit sandpaper, molding, etc. The roughened surface 82 of wall 74 enables light to pass from the fiber interior and strike the photoconductive surface 16, the light area progressively increasing as the distance from lamp 78 increases.

Erase device 12 is supported such that the front wall 78 thereof is in preset spaced relation to the photoconductive surface 16 of photoreceptor 15. Preferably, erase device 12 is mounted in a track-like receptacle (not shown) appended to the housing of scorotron 25. As a result, upon energization of lamp 78, a generally triangular-shaped bar or wedge of light of substantially constant or uniform intensity across the face of the erase device 12 impinges across the width of the photoconductive surface 16 to discharge or erase any residual charges on the photoconductive surface.

To operate reproduction machine 10, the leading edge of a document original to be copied is placed into the nip formed by the inlet roll pair 32 on platen 28. The presence of the document original is sensed by sensor 31, controller 21 responding to the signal output of sensor 31 to actuate the various machine operating components, i.e. drive motor 19, scorotron 25, exposure lamp 35, document and copy sheet feed clutches 34, 51, transfer/detack corotrons 53, 54, fuser 57, and lamp 78 of erase device 12 at the proper time and in the proper sequence as required to produce a copy of the document original 14 on copy sheet 29. Energization of lamp 78 of erase device 12 produces a generally triangular wedge or bar of light across the front wall 74 of fiber 70 to discharge any residual charges remaining on the photoconductive surface 16.

Figure 4:
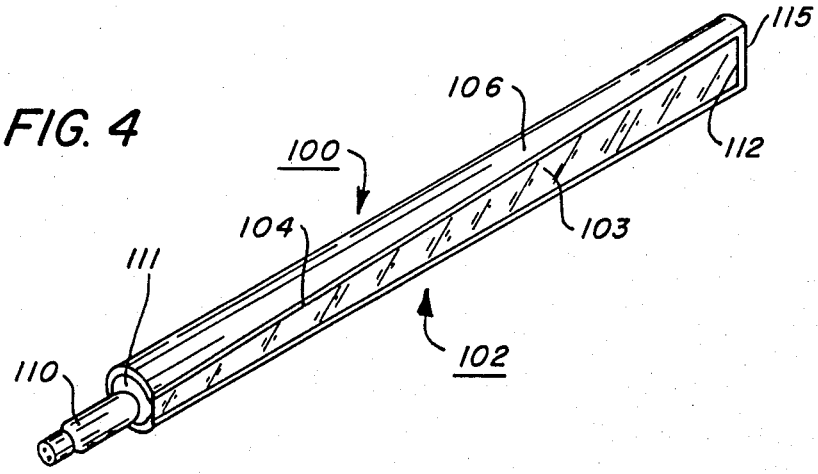
FIG 4 is an isometric view of an alternate erase device embodiment.

In the embodiment shown in FIG. 4, the erase device 100 thereshown comprises an elongated semi-circular light transmitting rod-like fiber 102 with the plane or flat surface 103 thereof facing photoreceptor 15. The rounded periphery 104 of fiber 102 is covered with a suitable cladding material 106 chosen to reflect light attempting to escape through the periphery 104 of fiber 102 back into the fiber interior. The flat surface 103 of fiber 102 is roughened to permit the discharge of light therefrom.

A suitable lamp 110 is provided at one end 111 of fiber 102, light from lamp 110 entering fiber 102 through end 111 and being transmitted axially therealong. Lamp 110 is preferably disposed within a suitable illumination cavity (not shown) to enhance the illumination efficiency of lamp 110 and prevent escape of light therefrom. The opposite end 112 of fiber 102 is preferably closed by a suitable cover 115 having an internal mirrored surface.

To balance the intensity of the light emitted from flat surface 104 of fiber 102 and accommodate the fall off in light intensity as the distance from lamp 110 increases, the surface area of flat surface 103 progressively increases as the distance from lamp 110 increases. Erase device 100 is supported and operated in the same manner as the erase device 12 described above.

While the erase devices 12, 100 are shown and described herein as having a single illumination source, i.e. lamps 78, 110 respectively, lamps may be provided at both ends of the light fibers 70, 102 instead. In that event, the roughened surface 82 of the erase device 12 would progressively increase to a maximum at substantially the midpoint of the fiber 70 in the FIGS. 2 and 3 embodiment. In the erase device 100, the surface area of flat surface 103 would progressively increase to a maximum at substantially the midpoint of fiber 102.

While in the FIGS. 2, 3 embodiment a separate cover 75 is shown, other covering means such as a coating of a suitable reflective paint, cladding material of the type shown in the FIG. 4 embodiment, etc. may be used instead. Similarly, covering other than cladding material 106 such as a rigid formed cover of the type shown in the FIGS. 2 and 3 embodiment, or a suitable coating, etc. may be used in place of cladding material 106 in the FIG. 4 embodiment. Additionally, fibers without any covering means may be contemplated.

While the erase device 12 has been described and shown herein as removing residual charges on the photoreceptor preparatory to recharging thereof, erase device may also be used as an interdocument erase device to discharge or erase non-imaging areas of the photoreceptor 15 to prevent developing thereof. Typical of these photoreceptor non-image areas are the charged but unused photoreceptor areas before the first document, between successive documents, and after the last document. In that instance, the erase device would be located upstream of development station 40.

While invention has been described with reference to the structure disclosed, it is not confined to the details set forth, but is intended to cover such modifications or changes as may come within the scope of the following claims.

We claim:

1. An erasing device for dissipating photoreceptor charges in a xerographic type reproduction machine having a photoreceptor, comprising:

(a) an elongated light transmitting fiber opposite said photoreceptor surface at substantially right angles to the path of movement of said photoreceptor, the axial length of said fiber being at least equal to the width of said photoreceptor surface;

(b) a light source at at least one end of said fiber, said fiber transmitting light from said light source axially along the interior thereof toward the opposite end of said fiber; and (c) light control means for progressively increasing the light discharge area of the section of said fiber facing said photoreceptor in proportion to the distance along the fiber from said light source to thereby offset the loss of light intensity as said light is being transmitted through the interior of said fiber.

2. The device according to claim 1 in which said fiber section comprises a substantially flat wall.

3. The device according to claim 2 in which said light transmitting portion comprises a roughened area of said wall.

4. The device according to claim 1 in which said light transmitting portion comprises a substantially flat wall, the surface of said wall increasing progressively as the distance from said light source along the axis of said fiber increases to thereby offset loss of light intensity as light is transmitted through said fiber.

5. The device according to claim 2 including a light source at each end of said fiber.

6. A device for discharging the photoconductive surface of a photoreceptor in a xerographic type reproduction machine or printer comprising:

(a) an elongated generally rectangular light transmitting fiber adapted for disposition across the path of movement of the photoconductive surface to be discharged, the axial length of said fiber being at least equal to the width of the photoconductive surface to be discharged;

(b) means for introducing light into one end of said fiber, said fiber transmitting said light axially through the interior of said fiber toward the fiber opposite end; and (c) the surface of said fiber one wall being formed to present a progressively increasing amount of lighted surface across the photoconductive surface opposite thereto as the distance from said fiber one end increases.

7. In a xerographic type printer including a movable photoreceptor, charging means to charge said photoreceptor, exposure means for exposing said photoreceptor following charging to create a latent electrostatic image on said photoreceptor, developer means to develop said image on said photoreceptor, means to transfer said developed image from said photoreceptor to a copy substrate material, and means to clean said photoreceptor following transfer of said developed image by said transfer means, the improvement comprising:

an elongated rod-like light transmitting member supported in predetermined spaced relation opposite the surface of said photoreceptor with the axis of said member substantially at right angles to the direction of movement of said photoreceptor for discharging said photoreceptor to erase photoreceptor residual charges prior to charging of said photoreceptor by said charging means, the axial length of said member being at least equal to the width of said photoreceptor, the surface of said member facing said photoreceptor being substantially flat, a light source at one end of said member to provide light for transmittal axially along the interior of said member, said member flat surface being roughened to facilitate the emission of light from said member interior through said member flat surface onto said photoreceptor, said roughened area increasing progressively from said member one end toward the opposite end of said member to provide substantially uniform emission of light from said member onto said photoreceptor across the length of said member.

* * * * *